US007779603B2

(12) United States Patent
Haga

(10) Patent No.: US 7,779,603 B2
(45) Date of Patent: Aug. 24, 2010

(54) SUPPORT STRUCTURE OF BUILDING

(75) Inventor: Tadashi Haga, Bunkyo-ku (JP)

(73) Assignee: Yoshino Sangyo Co., Ltd., Tokyo (JP)

( * ) Notice: Subject to any disclaimer, the term of this patent is extended or adjusted under 35 U.S.C. 154(b) by 333 days.

(21) Appl. No.: 11/793,227

(22) PCT Filed: May 11, 2005

(86) PCT No.: PCT/JP2005/008625

§ 371 (c)(1),
(2), (4) Date: Jun. 18, 2007

(87) PCT Pub. No.: WO2006/075412

PCT Pub. Date: Jul. 20, 2006

(65) Prior Publication Data

US 2008/0134621 A1 Jun. 12, 2008

(30) Foreign Application Priority Data

Jan. 17, 2005 (JP) ..... 2005-008766

(51) Int. Cl.
*E04C 3/00* (2006.01)

(52) U.S. Cl. ..... 52/853

(58) Field of Classification Search ..... 52/836, 52/843, 847, 848, 851, 853, 832, 834; 144/346, 144/352; 156/71, 184, 185, 189; 428/116
See application file for complete search history.

(56) References Cited

U.S. PATENT DOCUMENTS

| | | | | |
|---|---|---|---|---|
| 945,949 | A * | 1/1910 | Higgins | 52/834 |
| 2,718,941 | A * | 9/1955 | Robinson | 52/149 |
| 4,333,518 | A * | 6/1982 | Frost et al. | 165/8 |
| 4,335,783 | A * | 6/1982 | McBrayer et al. | 165/8 |
| 4,381,815 | A * | 5/1983 | Frost et al. | 165/10 |
| 5,747,177 | A | 5/1998 | Torimoto et al. | |
| 2005/0020391 | A1 | 1/2005 | Bao et al. | |
| 2009/0044486 | A1 * | 2/2009 | Kimura et al. | 52/831 |

FOREIGN PATENT DOCUMENTS

| | | | |
|---|---|---|---|
| FR | 2166338 A | | 8/1973 |
| JP | 38-6029 B | | 5/1963 |
| JP | 38-6029 B | * | 5/1963 |
| JP | 51-76572 | | 6/1976 |
| JP | 54-75014 | * | 5/1979 |
| JP | 1-159020 U | | 11/1989 |
| JP | 3032139 U | | 12/1996 |
| JP | 2000-265552 A | | 9/2000 |
| JP | 2002-317495 A | | 10/2002 |

OTHER PUBLICATIONS

International Search Report dated Jun. 14, 2005 with English translation of relevant portion (Four (4) pages).
European Search Report dated Oct. 17, 2008 (Three (3) pages).

* cited by examiner

*Primary Examiner*—David Dunn
*Assistant Examiner*—Adam Barlow
(74) *Attorney, Agent, or Firm*—Crowell & Moring LLP

(57) ABSTRACT

A central support section 1 having a rectangular cross-section was arranged at a central position, and a plurality of winding support sections 2-5, 6-9 . . . of a substantially elongate platelike shape were combined and arranged around the central support section, while being sequentially swirlingly and spirally wound, and each support section was fixed in a laminated condition between inside and outside. Furthermore, the support unit bodies 15 were engaged into a fitted condition from vertical directions and connected together by adhesive, thereby forming a square pillar 16. With this, there is provided a support structure that is capable of freely setting the size of the outer diameter while securing axis of the support and obtaining a sufficient strength.

7 Claims, 6 Drawing Sheets

1, 21...central support section
2-14, 22-37...winding support section
16, 38, 42...square pillar
40...support unit body
41...support unit group 1, 21...central support section 2-14, 22-37...winding support section 16, 38, 42...square pillar 40...support unit body 41...support unit group

SUPPORT STRUCTURE OF BUILDING

TECHNICAL FIELD

The present invention relates to a support structure of buildings, in which, while securing axis of each support used in buildings, its outer diameter can be set at any size.

BACKGROUND ART

As is generally known, a wooden support of large buildings, such as houses and ships, is one formed by a so-called one-piece, large-diameter, log member shaped by bringing down a large tree, or is produced by subjecting many wood chips of timber into a compression molding into a pillar that is one-piece having a predetermined outer diameter.

Patent Publication 1: Japanese Patent Application Publication 2000-265552 and the like.

DISCLOSURE OF THE INVENTION

Task to be Solved by the Invention

However, of the above-mentioned conventional support structures of building, for example, one formed of a log member is naturally limited in its outer diameter. Therefore, in the case of using them for a large building, many supports are necessary in order to secure strength. As a result, it is likely that the interior space is limited.

On the other hand, in the above-mentioned one formed by compressing wood chips, an axis as that of support is not secured. It is thus not possible to obtain a sufficient strength. Therefore, it is not possible to apply it to a large building.

The present invention was made in view of technical problems of the above-mentioned conventional support structures of building. Its object is to provide a support structure that is capable of freely setting the size of outer diameter, while securing axis of support and thereby obtaining a sufficient strength.

Means for Solving Task

The invention according to claim 1 is characterized in that a central support section having a rectangular cross-section is arranged at a central position and that a plurality of winding support sections of a substantially elongate platelike shape are combined and arranged around the central support section, while being sequentially spirally wound from a longitudinal direction, thereby fixing each support section under a laminated condition between inside and outside and setting an overall outer diameter at any size.

According to this invention, a support is constructed by arranging and fixing each winding support section around at least one central support section in a spiral manner like annual rings of a log. Therefore, the central support section becomes an axis, and each winding support section also functions as a core member. Thus, it is possible to have a sufficient compression strength of the entirety in the axial direction (longitudinal direction). Furthermore, each winding support section is spirally and organically attached. Therefore, it is also possible to sufficiently have rigidity in lateral direction. As a result, it is possible to prevent a deformation caused by drying, and it can be formed by using timber from forest-thinning.

It is possible to freely set the overall outer diameter by the amount of the assembly of each winding support section.

Therefore, it can be applied to any building irrespective of small buildings and large buildings. In particular, it can also be applied in this invention to a large building that cannot be met by an ordinary log. Therefore, it is possible to decrease its number to be applied to building in cooperation with high strength in the above-mentioned axial direction and the like. Thus, it becomes possible to have a large interior space, etc.

The invention according to claim 2 is characterized in that three of the winding support sections on the same circumference are formed to have widths that are substantially the same, the other winding support section is formed to have a width that is longer by a plate thickness that is then wound around the periphery, and each winding support section is combined and arranged while it is sequentially spirally wound.

According to this invention, it is not that each winding support section of the same width is simply attached from the outside, but one winding support section is set at a length that is the same as the thickness of the winding support section wound next. With this, it is possible to spirally and continuously connect each winding support section. Therefore, a connecting strength between each winding support section becomes large. As a result, the entirety of the support becomes high in rigidity and strength, and it can sufficiently be applied to a large building.

The inventions according to claims 3 and 4 are characterized in that a plurality of support units, each being combined by sequentially spirally winding a plurality of winding support sections around the central support section, are combined and fixed with each other to an assembled condition, thereby constituting one support.

According to these inventions, one support is formed by combining together a plurality of support unit bodies. Therefore, it is possible to freely set the size of the support. Furthermore, it becomes possible to further improve strength in the axial direction since one support can be formed with a plurality of central support sections.

The inventions according to claims 5 to 7 are characterized in that the central support section and the winding support sections are formed to be able to freely set their lengths in the axial direction.

According to these inventions, it is possible that the central support section and each winding support section are previously set at predetermined lengths and that, while extending these to conform to a building, these are freely stretched in the axial direction.

The inventions according to claims 8 and 9 are characterized in that, when each winding support section is spirally assembled from the central support section, the length of each support section in the axial direction is sequentially spirally changed as the winding support sections are wound outside from the central support section, and a plurality of support units, each comprising the central support section and the winding support sections, are connected together in the axial direction.

The invention according to claim 10 is characterized in that, when each winding-side support unit to be wound around the central support unit is spirally assembled, the length of each support unit in the axial direction is sequentially spirally changed as the winding-side support units are wound outside from the central support unit, and a plurality of support unit groups, each comprising the central support unit and the winding support units, are connected together in the axial direction.

According to the inventions of claims 8-10, for example, the winding support sections (the winding-side support units) are sequentially assembled from the central support section (the central side support unit) in a manner to have spiral steps in the axial direction. Therefore, it is possible to assemble support sections and support units, which are positioned above and below, into a fitted condition, thereby increasing each adhesion area. As a result, adhesion strengths of upper and lower support units and support unit groups are further improved, and strengths in the axial direction and in the diametral direction are also improved.

Furthermore, a single support can finally be formed, for example, only by previously setting each support section at the same length, then assembling it spirally, then connecting these support units from the vertical directions, and then cutting the upper and lower end portions. Therefore, yield of the material improves.

The invention according to claim 11 is an invention of a support assembly method. It is characterized in that it comprises a first step of arranging a central support section having a rectangular cross-section at an axial central position; a second step of combining and arranging a plurality of winding support sections of a substantially elongate platelike shape around the central support section, while being sequentially spirally wound, and adhering inner and outer surfaces of each winding support section, and a third step of cutting away an end portion of the final winding support section, which projects from an outer side surface of another winding support section, after termination of the winding.

According to this invention, it is only necessary to sequentially spirally assemble and fix each winding support section relative to the central support section. Therefore, such assembly operation is easy.

BEST MODE FOR CARRYING OUT THE INVENTION

Figure 1:
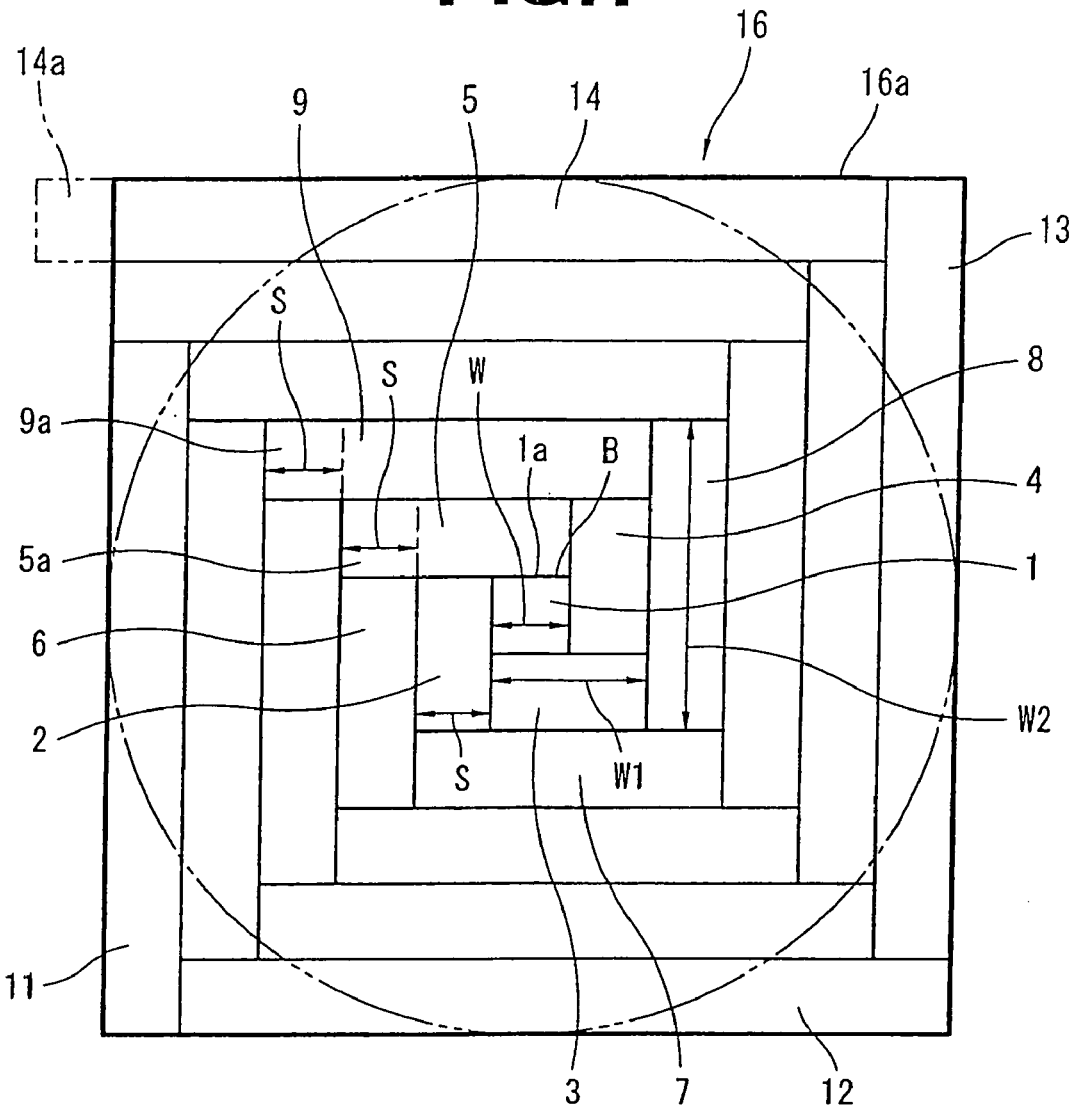
FIG. 1 is a plan view showing a first embodiment of a support structure according to the present invention.

In the following, embodiments of the support structure of building according to the present invention are described in detail, based on drawings.

FIG. 1 to FIG. 4 show the first embodiment of the present invention. This support structure is constituted of a wooden central support section 1 disposed at a central position and a plurality of wooden winding support sections 2, 3, 4, 5 . . . , which are spirally windingly disposed at a periphery of the central support section 1.

The central support section 1 is formed of a pillar having a substantially square cross-section, and its length in the axial direction is freely set.

The above-mentioned plurality of winding support sections 2, 3, 4, 5 . . . are each formed of pillars that are substantially rectangular in cross-section, and their lengths in the axial direction are set to be the same as the length of the central support section 1. The thickness S of each winding support section is set to be the same, and the width W1 thereof is set at a size double, triple . . . in sequence as they are wound outwardly from the central side.

In other words, at first, the four winding support sections 2, 3, 4, 5 are spirally disposed on and bonded to four peripheral surfaces 1*a* of the central support section 1 with adhesive B. Of these, the three winding support sections 2, 3, 4 are set at a width W1 that is two times the width W of the central support section. Of the other winding support section 5, an end portion 5*a* is set to be longer by the thickness S of the winding support sections 6, 7, 8, 9, which are next wound around the periphery.

Furthermore, of the next three winding support sections 6-8, which are wound on the peripheral surfaces of winding support sections 2-5, the width W2 is set at a size three times the central support section 1. Of the other winding support section 9, an end portion 9*a* is set to be longer by the thickness S of the next winding support section.

As mentioned above, of the winding support sections 2-5, 6-9, . . . , which are sequentially wound outside from the central support section 1, the width Wn of the three is set to be larger double again and again relative to the width W of the central support section 1, and the other one is set to be larger by the thickness S of the winding support section wound on this peripheral side.

The length of each winding support section 2-9 . . . in the axial direction is set at a length that is substantially the same as that of the central support section 1. In other words, it is set at any length.

As a method for assembling each winding support section 2-9 . . . , each winding support section 2-4 of the onefold is assembled by aligning two timbers having the same width as that of the central support section and then by bonding them together by adhesive from the lateral direction. Furthermore, each of the other winding support section 5 and the winding support sections 6-8 of the twofold is assembled by aligning three timbers having the same width as that of the central support section and then by bonding them together by adhesive under this condition. Similarly, each winding support section of the threefold or further is assembled by making timbers having the same width as that of the central support section 1 double again and again and then by bonding them together in parallel condition.

The winding support sections 2-5, 6-9 . . . are spirally wound fivefold at last around the central support section 1. Each winding support section is strongly bonded at its inside and outside surfaces by adhesive B.

Figure 2:
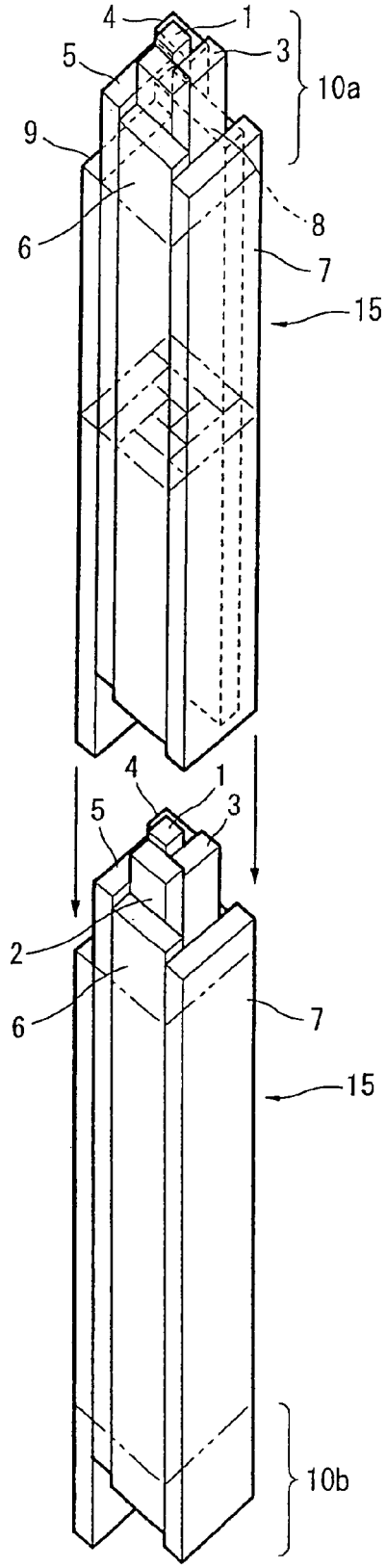
FIG. 2 is a perspective view showing a condition in which each support unit of the present embodiment is connected from the vertical direction.

As shown in FIG. 2, when each winding support section 2-9 . . . is spirally assembled from this central support section 1, the length of each support section 1-9 . . . in the axial direction is sequentially spirally changed as the winding support sections 2-9 . . . are wound outside from the central support section 1. A plurality of support unit bodies 15, 15 . . . , each being formed of the central support section 1 and the winding support sections 2-9 . . . , are connected into a fitted condition from the vertical directions. Upon this, support sections 1-9 of the upper and lower support unit bodies are bonded with each other by adhesive B. In FIG. 2, only the winding support sections 2-9 are shown by omitting the winding support sections that are shown in FIG. 1 and are further wound around the periphery of the winding support sections 6-9.

As shown in FIG. 1, of the four winding support sections 11-14 wound at last in the winding support sections 2 . . .

wound to have predetermined sizes, an end portion 14*a* of the winding support section 14, which is long by the thickness of S, is cut off.

In case that the support sections 1-9 are assembled spirally to have steps as mentioned hereinabove and the support unit bodies 15 are connected together into a fitted condition from vertical directions to make the whole have a predetermined length at last, the upper end portion projects upward and the lower end portion is in a concave form by the spiral form of the support sections 1-9 . . . . Therefore, each of these projection portion 10*a* and concave portion 10*a* is cut off.

Figure 3:
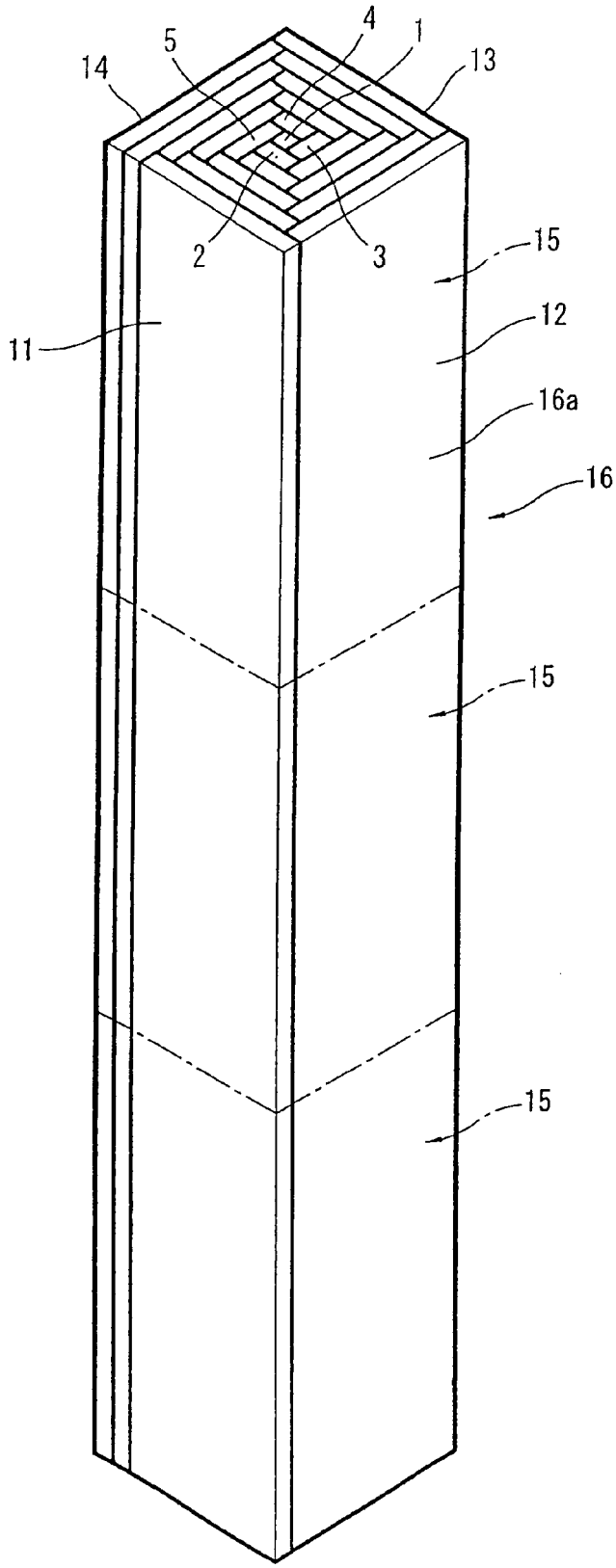
FIG. 3 is a perspective view showing a square pillar formed finally of the present embodiment.

With this, as shown in FIG. 3, a single square pillar (support) having a desired length and a relatively large cross-section is formed.

Then, it is possible to form a smooth surface by subjecting the entirety of the surface 16*a* of this square pillar 16 to machining. In some cases, it is also possible to subject the surface 16*a* to carving and painting after machining to produce a decorated pillar. It is also possible to form a round pillar having a circular cross-section by cutting off the corner portions of the square pillar 16 as shown by a dash double-dotted line of FIG. 1. After conducting a surface treatment of the square pillar 16, it is used as a pillar of a predetermined building.

As mentioned hereinabove, according to a support structure of the present embodiment, a square pillar 16 is constructed by arranging and fixing each winding support section 2-14 . . . around at least one central support section 1 in a spiral manner like annual rings of a log. Therefore, the central support section 1 becomes an axis, and each winding support section 2-14 . . . also functions as a core member. Thus, it is possible to have a sufficient compression strength of the entirety in the axial direction (longitudinal direction). Furthermore, each winding support section is spirally and organically attached. Therefore, it is also possible to sufficiently have rigidity in lateral direction.

As a result, it is possible to prevent a deformation caused by drying, and it can be formed by using timber from forest-thinning.

It is possible to freely set the outer diameter of the entirety of the square pillar 16 (round pillar) by the amount of the assembly of each winding support section 2-14 . . . . Therefore, it can be applied to any building irrespective of small buildings and large buildings. In particular, it can also be applied to a large building that cannot be met by an ordinary log. Therefore, it is possible to decrease its number to be applied to building in cooperation with high strength in the above-mentioned axial direction and the like. Thus, it becomes possible to have a large interior space and the like.

It is not that each winding support section 2 . . . 14 . . . of the same width is simply attached from the outside, but one winding support section 5, 9 . . . 14 is set at a length that is the same as the thickness S of the winding support section wound next. With this, it is possible to spirally and continuously connect each winding support section 2-14 . . . . Therefore, a connecting strength between the central support section 1 and each winding support section 2-14 . . . becomes large.

As a result, the entirety of the square pillar (support) becomes high in rigidity and strength, and it can sufficiently be applied to a large building.

According to this embodiment, it only necessary to sequentially spirally assemble and fix each winding support section 2 relative to the central support section 1. Therefore, the assembly operation is easy.

Furthermore, according to this embodiment, as mentioned above, when the winding support sections 2-14 are assembled while winding them from the central support section 1, the support sections 1-14 are sequentially assembled in a manner to have spiral steps in the axial direction. Therefore, in case that the support unit bodies are connected together from the axial direction, it is possible to assemble each support section 1-14, which are positioned above and below, into a fitted condition, thereby increasing each adhesion area.

As a result, adhesion strength of the upper and lower support unit bodies 15 are further improved, and strengths in the axial direction and in the diametral direction are also improved.

Furthermore, a single square pillar 16 can finally be formed only by previously setting each support section 1-14 to have the same length, then assembling it spirally, then connecting these support unit bodies 15 from the vertical directions, and then cutting the upper and lower end portions 10*a*, 10*b*. Therefore, yield of the material improves.

Furthermore, according to this embodiment, in order to form each winding support section 2-9 . . . as mentioned above, square timbers having the same length as that of the central support section 1 are used, and these are connected in parallel, while sequentially increasing these, to form respective ones. Therefore, yield of the material further improves, and it is possible to lower the cost.

Figure 4:
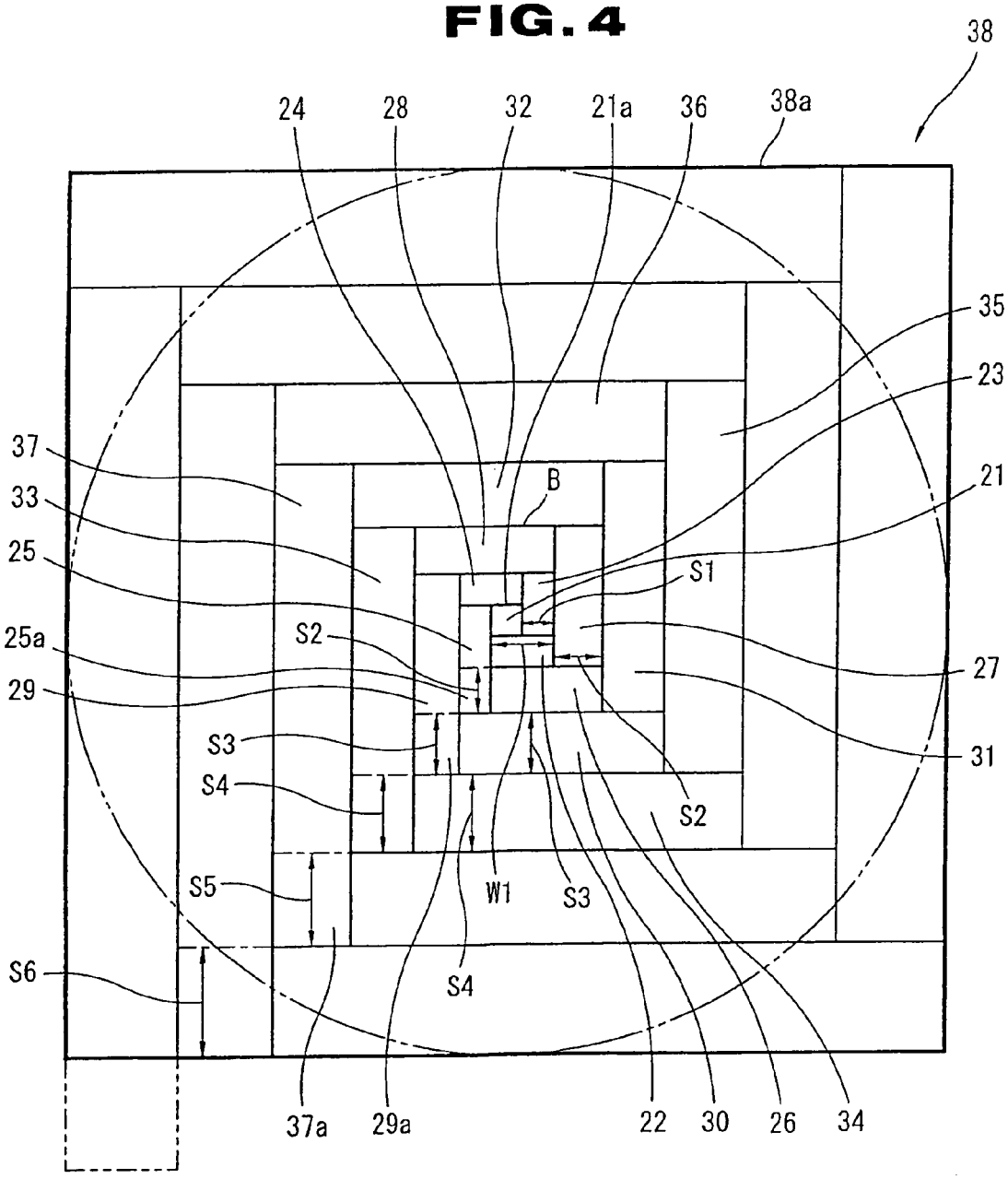
FIG. 4 is a plan view showing a second embodiment of the present invention.

FIG. 4 shows a second embodiment of the present invention. A central support section 21 is formed to have an almost square cross-section, which is the same as that of the first embodiment. However, the thicknesses S1 . . . of the winding support sections 22 . . . are set to be sequentially larger as it goes to the peripheral side.

That is, the width W1 of each winding support section 22-25, which is wound and arranged on a peripheral surface 21*a* of the central support section 21, is set at about two times that of the central support section 21, and its thickness S1 is set to be almost the same as the width S of the central support section 21. The thickness S2 of each winding support section 26-29 of the twofold, which is wound and arranged on each peripheral surface of each winding support section 22-25 of the onefold, is set at 1.5 times that of the winding support section 22-25. Therefore, an end portion 25*a* of the last winding support section 25 of the onefold is set at a length projecting by the thickness S2 of the twofold.

The thickness S3 of the winding support sections 30-33 of the threefold is set at a size that is 1.75 times that of the twofold. Therefore, an end portion 29*a* of the last winding support section 29 of the twofold is also set at a length projecting by the thickness S3 of the threefold.

Furthermore, the thickness S4 of the winding support sections 34-37 of the fourfold is set at a thickness that is 1.8 times that of the threefold. Therefore, an end portion 37*a* of the last winding support section 37 of the threefold is set at a length projecting by the thickness S4 of the fourfold.

In such manner, the thickness Sn of the winding support sections 22-37 is set to be sequentially larger as it goes to the peripheral side, and an end portion of the last winding support section of each fold is formed to project by the thickness of the peripheral side.

Similar to the first embodiment, the outer surface 21*a* of the central support section 21 and the inner and outer surfaces of each winding support section 22 . . . are strongly bonded together by adhesive B, and its length in the axial length is freely set depending on the size of building or the like.

Therefore, according to this embodiment, provided that the outer diameter of a square pillar 38 formed by each support section 21, 22 . . . is the same, it becomes possible to lower the number of the winding support sections 22 . . . as compared with the case of the first embodiment.

After forming into the single square pillar 38, similar to the first embodiment, it is possible to form a decorated pillar by suitably putting carving and painting after surface treatment or to form a round pillar as shown by a dash double-dotted line of FIG. 4.

Figure 5:
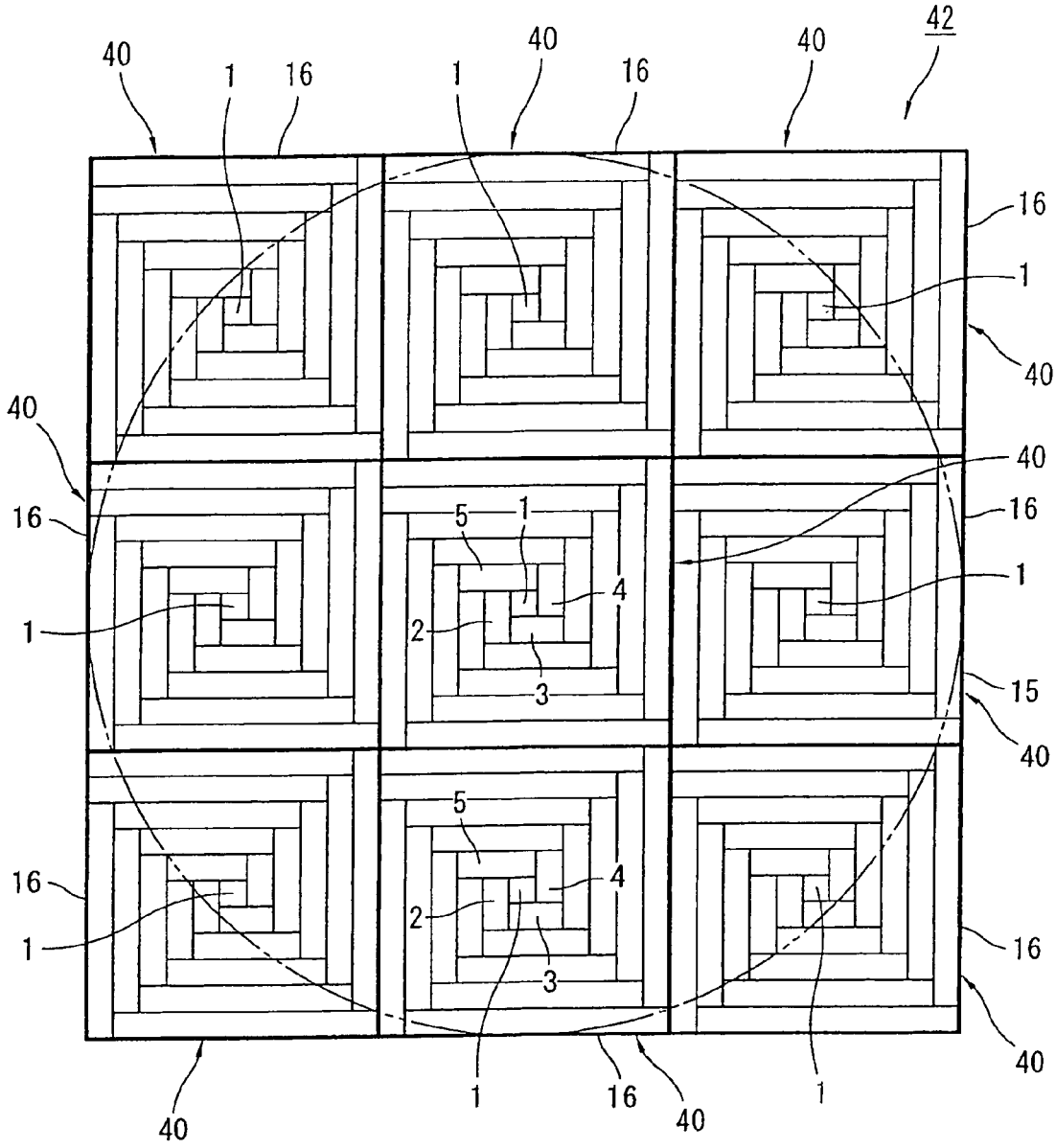
FIG. 5 is a plan view showing a third embodiment of the present invention.

FIG. 5 shows a third embodiment of the present invention. For example, the square pillar 16 formed by the first embodiment is used as a single support unit body 40, and these 9 support unit bodies 40 . . . are combined and bonded to each other, thereby forming a square pillar 42.

Figure 6:
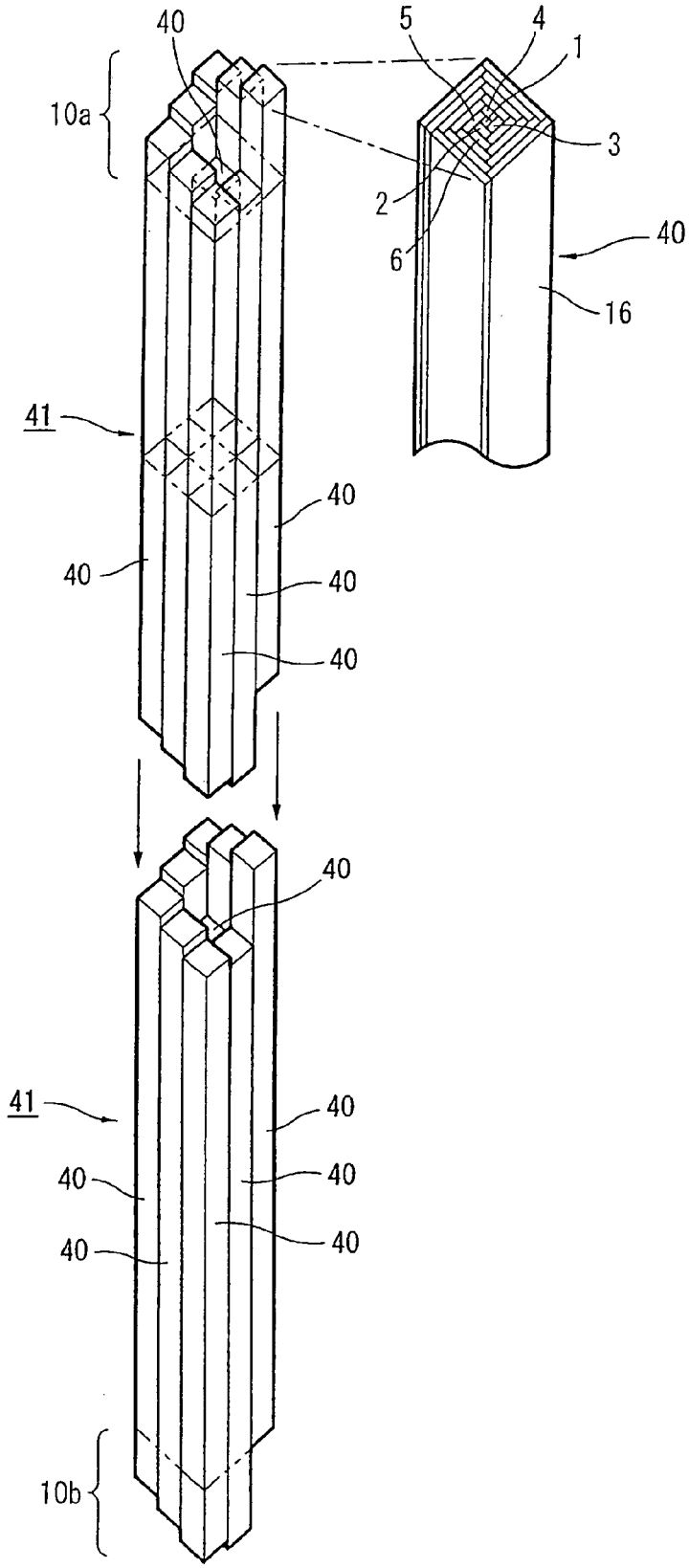
FIG. 6 is a perspective view showing a condition in which each support unit group in the third embodiment is connected from the vertical direction.

Also in this embodiment, similar to the first and second embodiments, as shown in FIG. 6, when each support unit body 40 was outside wound and assembled from the central support unit body 40, the length of each support unit body 40 in the axial direction was sequentially spirally changed to have steps, and a plurality of support unit groups 41 formed of the central support unit body 40 and the support unit bodies 40 on the winding side were connected from the axial directions. The length of each support unit body 40 . . . in the axial direction is set to be almost the same.

Therefore, according to this embodiment, since a single square pillar 42 is formed by combining a plurality of the support unit bodies 40, it is possible to freely set the size of the square pillar 42. Furthermore, since it is possible to form a plurality of the central support sections 1 . . . in a single square pillar 42, it becomes possible to further increase compression strength in the axial direction.

Furthermore, as mentioned above, a single square pillar 42 is formed by spirally winding each support unit body 40 . . . and then by connecting a plurality of support unit groups 41 from vertical directions. Therefore, similar to the first and second embodiments, bonding strength in vertical directions becomes higher, and yield of the material becomes good.

The present invention is not limited to each of the above embodiments. For example, it is also possible to make the number of the winding support sections less by setting the outer diameter of the central support section to a relatively large one. Furthermore, it is also possible to freely set the width and the thickness of each winding support section in accordance with the outer diameter of the support, etc.

Furthermore, for example, it is naturally possible to previously process the winding support sections 2-14 in the first embodiment into ones of sizes having respective widths without connecting ones of the central support section 1 in parallel.

Although wood was used in each embodiment, it is also possible to form the central support section with wood and the winding support sections with another material, for example, high-hardness synthetic resin material, etc.

The invention claimed is:

1. A support structure of a building, comprising:

a central support piece having a rectangular cross-section and being arranged at a central position of the support structure, and a plurality of winding support pieces having a substantially elongate platelike shape and being combined and arranged around the central support piece, while being sequentially spirally wound when viewed from a longitudinal direction, wherein the central support piece and adjacent winding support pieces are adhered to each other, wherein two of the adjacent winding support pieces positioned inside and outside relative to each other are adhered to each other, wherein first, second, third, fourth, and fifth winding support pieces are sequentially spirally wound around the central support piece when viewed from the longitudinal direction, wherein only the first to fourth winding support pieces form a first layer around the central support piece, and the fifth winding support piece is one of only four winding support pieces that form a second layer around the first layer, and wherein the fourth winding support piece protrudes by a length that is equal to a thickness of the fifth winding support piece.

2. A support structure of a building according to claim 1, wherein a plurality of support units, each being combined by sequentially spirally winding a plurality of winding support pieces around the central support piece, are combined and fixed with each other to an assembled condition, thereby constituting one support.

3. A support structure of a building according to claim 1, wherein the central support piece and the winding support pieces are formed to be able to freely set their lengths in the longitudinal direction.

4. A support structure of a building according to claim 2, wherein the central support piece and the winding support pieces are formed to be able to freely set their lengths in the longitudinal direction.

5. A support structure of a building according to claim 1, wherein, when each winding support piece is spirally assembled around the central support piece, the length of each support piece in the longitudinal direction is sequentially spirally changed as the winding support pieces are wound outside from the central support piece, and a plurality of support units, each comprising the central support piece and the winding support pieces, are connected together in the longitudinal direction.

6. A support structure of a building according to claim 2, wherein, when each winding-side support unit body to be wound around the central support unit body is spirally assembled, the length of each support unit body in the longitudinal direction is sequentially spirally changed as the winding-side support unit bodies are wound outside from the central support unit body, and a plurality of support unit groups, each comprising the central support unit body and the winding support unit bodies, are connected together in the longitudinal direction.

7. A support structure of a building according to claim 1, wherein the first winding support piece protrudes by a length that is equal to a thickness of the second winding support piece, wherein the second winding support piece protrudes by a length that is equal to a thickness of the third winding support piece, and wherein the third winding support piece protrudes by a length that is equal to a thickness of the fourth winding support piece.

* * * * *